US005865235A

United States Patent [19]

Krupke et al.

[11] Patent Number: 5,865,235

[45] Date of Patent: Feb. 2, 1999

[54] COUNTERBALANCE MECHANISM FOR VERTICAL OPENING DOOR

[75] Inventors: LeRoy G. Krupke, Carrollton; Foad Vafaie, Plano; Douglas R. Fuller, Flower Mound, all of Tex.; Pierre-Louis Foucault, St-Lambert, Canada

[73] Assignee: Overhead Door Corporation, Dallas, Tex.

[21] Appl. No.: 787,791

[22] Filed: Jan. 23, 1997

[51] Int. Cl.[6] ..... E05F 11/00

[52] U.S. Cl. ..... 160/191; 160/201

[58] Field of Search ..... 160/201, 189, 160/191, 192, 193, 315, 133; 16/197, 198, DIG. 1, DIG. 7; 49/200

[56] References Cited

U.S. PATENT DOCUMENTS

| | | | |
|---|---|---|---|
| 1,827,433 | 10/1931 | Kendall . | |
| 1,994,142 | 3/1935 | Madsen | 160/201 X |
| 2,093,019 | 9/1937 | Norberg | 20/20 |
| 2,099,191 | 11/1937 | Blodgett | 20/20 |
| 2,257,484 | 9/1941 | Rowe | 160/201 X |
| 2,932,057 | 4/1960 | Pemberton | 16/198 |
| 3,038,535 | 6/1962 | Stroup et al. | 160/191 |
| 3,615,065 | 10/1971 | Elliott | 160/191 X |
| 3,635,277 | 1/1972 | Bahnsen | 160/191 |
| 3,921,761 | 11/1975 | Votroubek et al. | 185/39 |
| 4,882,806 | 11/1989 | Davis | 16/198 |
| 4,981,165 | 1/1991 | Miller et al. | 160/191 |
| 5,239,777 | 8/1993 | Husselton | 49/200 |
| 5,419,010 | 5/1995 | Mullet | 16/198 |
| 5,615,723 | 4/1997 | Carper | 160/191 |
| 5,632,063 | 5/1997 | Carper et al. | 160/191 X |
| 5,636,678 | 6/1997 | Carper et al. | 160/201 X |
| 5,638,640 | 6/1997 | Harbeck et al. | 49/200 X |

*Primary Examiner*—David M. Purol

*Attorney, Agent, or Firm*—Akin, Gump, Strauss, Hauer & Feld, L.L.P.

[57] ABSTRACT

A counterbalance mechanism for a sectional garage door includes an elongated shaft mounted above the door opening and supporting spaced apart cable drums connected to respective cables which are connected at one end to the door for exerting a counterbalance force thereon. Opposed torsion springs are connected to the cable drums at one end, respectively, and to respective hub members which are axially slidable on but nonrotatable with respect to the shaft. The cable drums are provided with detachable bushing members for engagement with the support brackets. The shaft is connected to a non-reversible worm gear drive at one end. The worm gear drive may be actuated to selectively vary the torsional deflection of the counterbalance springs by rotating the worm and a ring gear meshed therewith. The worm gear drive may be detachably mounted on one or the other of shaft support brackets and a lock plate is supported on the shaft and engageable with a bracket to prevent rotation of the shaft when the drive mechanism is removed. The door guide members are engaged with coil compression springs for centering the door between its guide tracks and to minimize skewing of the door during opening and closing movement.

34 Claims, 9 Drawing Sheets

COUNTERBALANCE MECHANISM FOR VERTICAL OPENING DOOR

SPECIFICATION

1. Field of the Invention

The present invention pertains to a vertical opening counterbalanced door, including a torsion spring counterbalance mechanism and a gear drive adjustment device.

2. Background

Large, vertical opening doors, such as commercial and residential sectional garage doors, usually require mechanisms to counterbalance the weight of the door to minimize door opening effort and to control movement of the door from an open to a closed position. Large sectional garage doors for commercial and residential applications may be manually or power operated. In either case, and particularly for manual operation, counterbalance mechanisms have been used for many years to counterbalance the weight of the door and control its opening and closing movements so that one person can easily control operation of the door. Counterbalance mechanisms are advantageous for power operated vertical opening doors to reduce the motor power requirements and strength of the door opening and closing mechanism. In other words, lighter weight lower cost door control mechanisms may be used if a counterbalance mechanism is connected to the door to assist the opening and closing action. Still further, the provision of a counterbalance mechanism minimizes the chance of rapid and uncontrolled closing movement of the door in the event of failure of the door opening and closing mechanism.

A widely used type of counterbalance apparatus comprises, generally, a pair of spaced apart cable drums connected to flexible cables which, in turn, are connected to lower opposed edges of the door. The cable drums are usually mounted on a shaft which is supported above the door opening and is connected to one or more torsion springs which are fixed at one end to the shaft and are secured to the cable drums at the opposite end so that the cable drums are biased to rotate in a direction which winds the cables onto the drum and counteracts the weight of the door connected to the cables. The torsion springs are adjusted to properly balance the weight of the door so that minimal opening and closing effort is required, either manually or motor controlled.

Conventional, low cost adjustment mechanism for the above mentioned type of counterbalance apparatus, and widely used in the door industry, is characterized by generally cylindrical collars which are connected to the so-called fixed ends of the torsion springs and are mounted on the aforementioned shaft for adjusting the deflection of the springs to preset the counterbalance effort. The aforementioned collars usually include one or more setscrews which lock the collars to the shaft to prevent rotation except during adjustment of the spring deflection. The collars also include sockets for receiving winding bars whereby the springs are manually preset by rotating the collars using the winding bars and then locking the collars to the shaft with the set screws. This method of adjustment is cumbersome and is subject to inaccuracies in that the preset torques on the respective springs may not be easily maintained at the same values.

The above-mentioned disadvantages of manually adjustable torsion springs have been addressed by providing spring adjustment mechanisms comprising a worm gear drive assembly connected to the spring support shaft in such a way that the shaft may be rotated by operation of the worm gear drive assembly to rotate the shaft and wherein the shaft is then locked against reverse rotation by the worm gear drive due to its one way drive characteristic.

Devices utilizing a worm gear drive have been developed as an attachment or "add on" feature to provide for adjusting the aforementioned spring support collars on manually adjustable doors. Worm gear drive arrangements have also been provided which are adapted to be connected to the cable drum support shaft midway between the opposed shaft support brackets and over the center of the door opening. Prior art door counterbalance apparatus including adjustment mechanisms of the types described above have been somewhat difficult to use, particularly if they are centered between the opposite sides of the door, since access to the mechanism may be restricted if a vehicle or other object is disposed in the garage or other space enclosed by the door. Still further, prior art counterbalance apparatus with worm gear drive adjustment mechanisms have been somewhat complex, expensive to manufacture, difficult to operate and service and otherwise plagued with shortcomings which have made it desirable to seek further improvements in such apparatus and mechanisms for vertical opening doors, including sectional doors used in commercial and residential buildings and garages. It is to these ends that the present invention has been developed.

SUMMARY OF THE INVENTION

The present invention provides an improved counterbalance mechanism for vertical opening doors, including sectional garage doors used in commercial and residential buildings, for example.

In accordance with one aspect of the invention a counterbalance mechanism is provided which includes torsion spring means supported on a shaft which is supported generally above a door, in its closed position, and which spring means are connected to spaced apart cable drums having door counterbalance cables wound thereon, and a counterbalance adjustment mechanism including a gear drive assembly mounted at one side of the door opening and on a bracket which also supports one end of the shaft. The counterbalance adjustment mechanism is easily accessible from one side of the garage opening for adjustment of the counterbalance effort by effecting rotation on the shaft to wind the torsion springs to preset the torque exerted by the springs and the counterbalance effort exerted on the door when the door is in a closed position.

In accordance with another aspect of the present invention, a counterbalance adjustment mechanism is provided wherein a gear drive assembly, in particular a worm gear drive assembly, may be mounted on the adjustment mechanism support structure and operated to adjust the counterbalance springs and then removed from the support mechanism for use in adjusting other door counterbalance mechanisms. In particular, the embodiment of the invention which utilizes a detachable drive assembly includes a locking device for locking the spring support shaft in the adjusted position. Moreover, the counterbalance spring support shaft may be adjusted from either end of the shaft and the shaft support structure is adapted for supporting the drive mechanism at either end of the shaft.

In accordance with yet another aspect of the present invention, a unique arrangement of torsion counterbalance springs is provided wherein the springs are sleeved over and secured at one end to a normally stationary shaft having at least a portion of noncircular cross section so that cooperating spring support parts may be mounted on the shaft nonrotatably. Opposed counterbalance cable drums are provided which are supported on bearings sleeved over the shaft and the drums are operable to wind and unwind the counterbalance cables connected to the door in response to movement of the door.

In accordance with still another aspect of the present invention, a counterbalance mechanism is provided for a garage door or the like wherein an improved construction of cable drum support bearings and associated structure is provided and an improved construction of a torsion spring support hub is also provided. In particular, the spring support hubs which are adapted for rotation with the counterbalance spring and drum support shaft are of improved construction and are adapted for axial sliding movement on the shaft to accommodate changes in effective spring length as the torsional windup of the springs is adjusted.

The present invention also provides an improved arrangement of support and guide members, such as opposed sets of guide rollers, for a vertical opening sectional door wherein the guide members are biased into engagement with associated guide tracks, or equivalent members, in such a way that the door is centered between the guide tracks by resilient spring means to counteract any misalignment of the door during opening and closing movement as a result of minor differences in the counterbalance effort of the opposed sets of counterbalance springs and associated cables.

The counterbalance mechanism of the present invention eliminates the need for adjustable spring collars or hubs which are locked by set screws and are adjusted by winding bars, provides a simplified and novel support arrangement for opposed counterbalance cable drums and includes a simplified and novel counterbalance spring adjustment mechanism comprising a nonreversible worm gear drive assembly mounted at one side of the door on a support bracket for easy access to perform counterbalance adjustment operations. The mechanism is of uncomplicated construction, requiring a minimal number of parts and may be constructed using conventional manufacturing techniques and engineering materials. Those skilled in the art will further appreciate the advantages and superior features of the invention upon reading the detailed description which follows in conjunction with the drawing.

DESCRIPTION OF PREFERRED EMBODIMENTS

Figure 1:
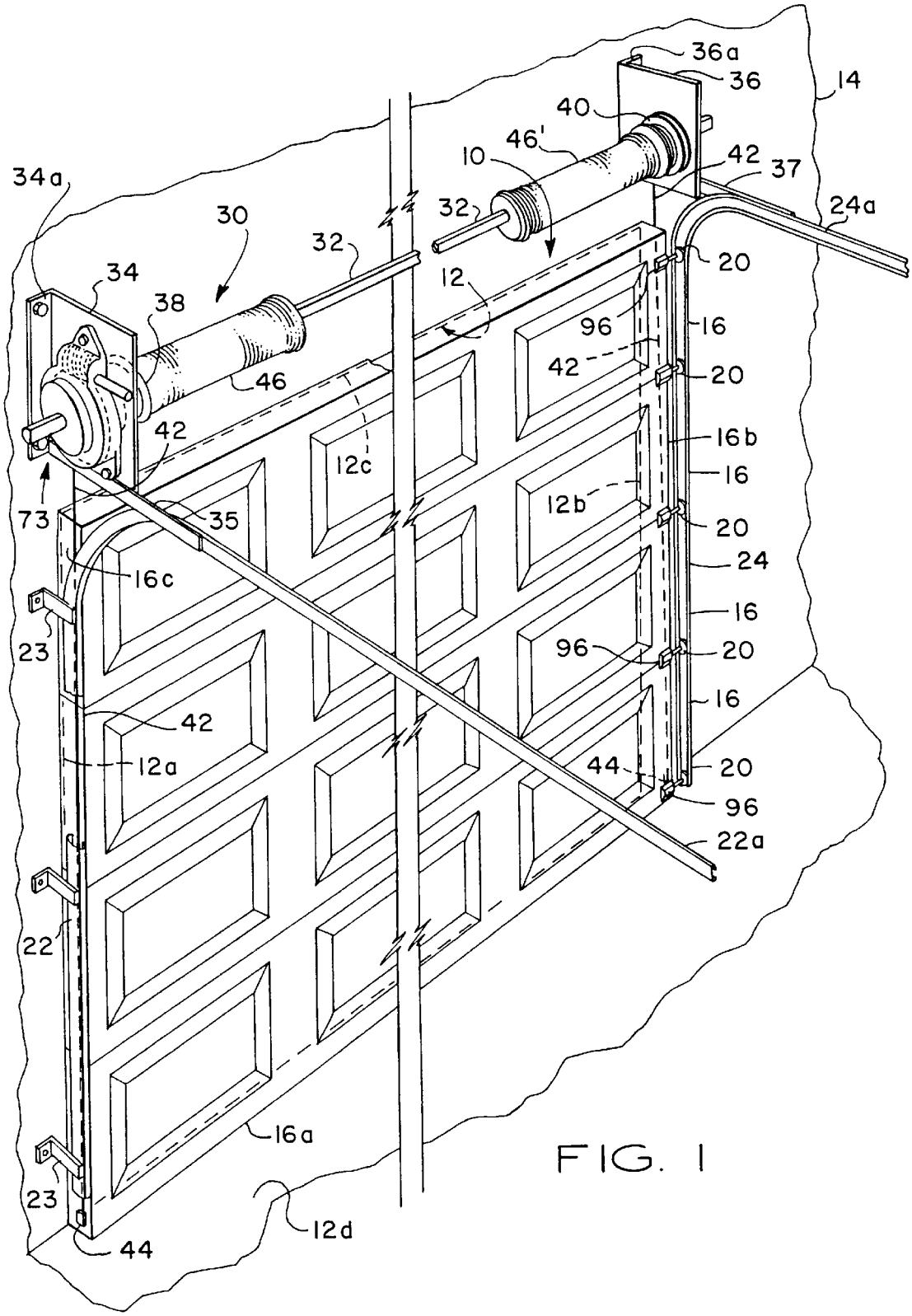
FIG. 1 is a perspective view of a sectional, vertically openable garage door including the counterbalance mechanism of the present invention.

In the description which follows like parts are marked throughout the specification and drawing with the same reference numerals, respectively. The drawing figures are not necessarily to scale and certain features may be shown in a somewhat generalized or schematic form in the interest of clarity and conciseness.

Referring to FIG. 1, there is illustrated a vertical opening sectional door, generally designated by the numeral 10 which is supported for closure over an opening 12 in a generally vertical building wall 14. The opening 12 has opposed vertical side edges 12*a* and 12*b* and a generally horizontal top edge 12*c*. The bottom edge of the opening 12 is delimited by a floor 12*d*. The door 10 is preferably of an articulated or sectional construction made up of a plurality of elongated, generally rectangular panels 16 which are hinged together for folding movement with respect to each other by spaced apart hinges, not shown. The door 10 is also provided with opposed sets of guide members comprising rollers 20, one set on one side shown in FIG. 1, suitably supported spaced apart along the side edges 16*b* and 16*c* of the panels 16 and disposed for movement in opposed door guide and support tracks 22 and 24. The tracks 22 and 24 are at least partially supported in a building defined by the wall 14 in a conventional manner by structural components, including brackets 23. The door 10 is operable to be moved from its closed position shown in the drawing figure along the tracks 22 and 24 to a substantially open position supported by the tracks along horizontal runs 22*a* and 24*a*, respectively. The door 10 may be adapted for manual opening and closing or the door may also be connected to suitable mechanism, of a type well known and not shown, for power operation of the door for movement between open and closed positions.

The door 10, which is exemplary, is characterized as a sectional, residential garage door having nominal dimensions of about seven or eight foot height by fourteen to eighteen foot width, for example. Although modern sectional garage doors of the type manufactured by the assignee of the present invention are relatively lightweight, they advantageously utilize counterbalance mechanisms to assist in door opening and closing movements, whether or not such movements are manual or power operated.

Figure 2:
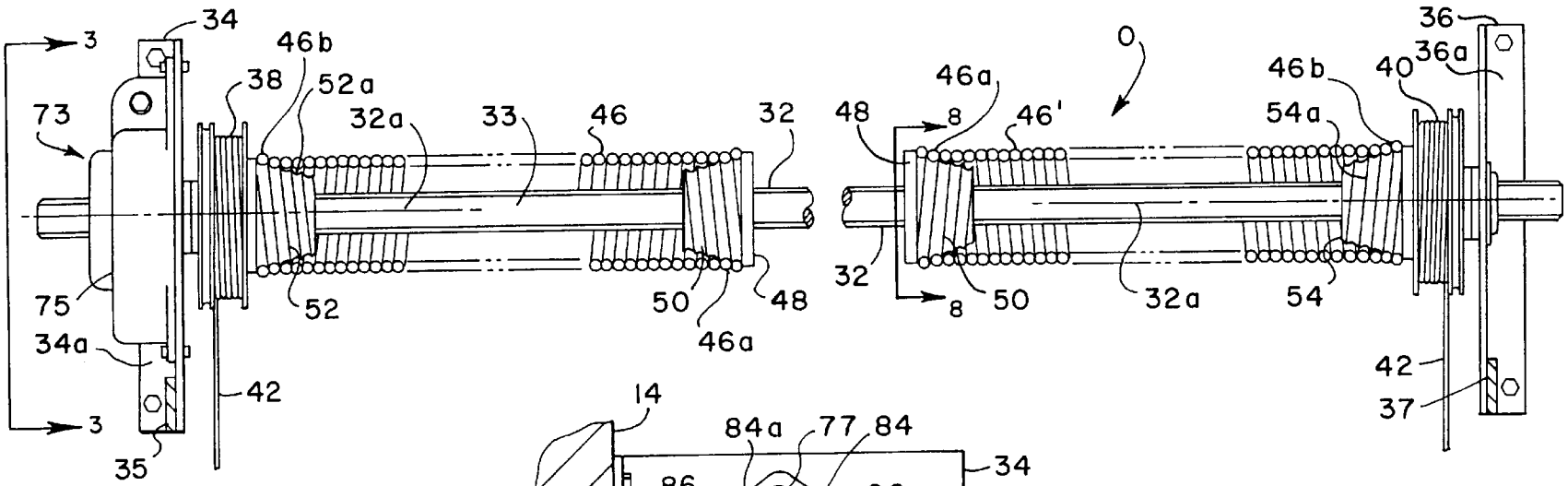
FIG. 2 is a detail elevation of the counterbalance mechanism on a larger scale.
Figure 3:
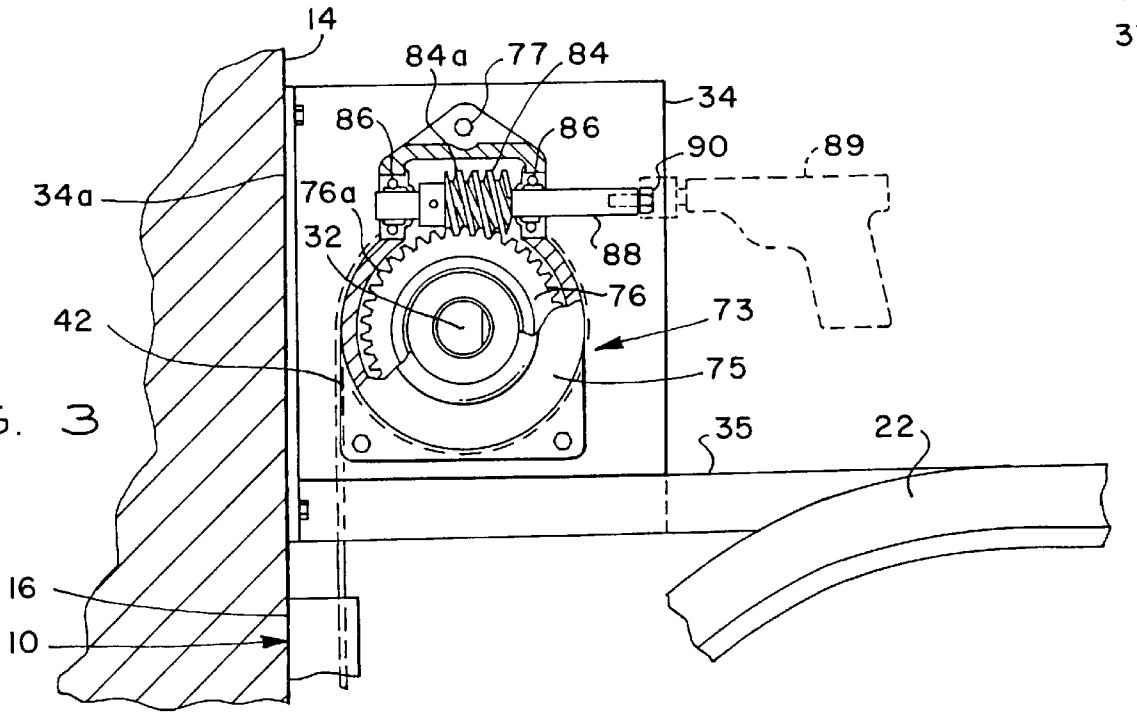
FIG. 3 is a view taken generally from the line 3—3 of FIG. 2.

In this last-mentioned regard, the door 10 is provided with one preferred embodiment of a counterbalance mechanism in accordance with the present invention, and generally designated by the numeral 30 in FIG. 1. The counterbalance mechanism 30 includes an elongated, normally stationary shaft 32 which is supported on and between two spaced apart plate-like brackets 34 and 36 having wall mounting flanges 34*a* and 36*a,* respectively. Brackets 34 and 36, as shown in FIGS. 2 and 3 also, are suitably mounted on the wall 14 and are preferably connected to opposed generally horizontally extending struts 35 and 37, respectively. The struts 35 and 37 are also suitably connected to the tracks 22 and 24, respectively, as shown. Opposed spaced apart cable drums 38 and 40 are disposed on and around the shaft 32 and supported for rotation relative to the shaft in a manner to be described further herein. Each of the cable drums 38 and 40 has wound thereon, respectively, an elongated flexible cable 42. The cables 42 are each, respectively, connected to lower side edges of the door 10 at connector members 44, see FIG. 1, suitably mounted on the lowermost panel 16 adjacent or near a bottom edge 16*a* thereof. The cable drums 38 and 40 are biased to wind the cables 42 thereon to counterbalance the weight of the door 10 so that minimal opening and closing effort is required and so that the door is not subject to uncontrolled acceleration under its own weight as it moves from an open position to a closed position.

Figure 8:
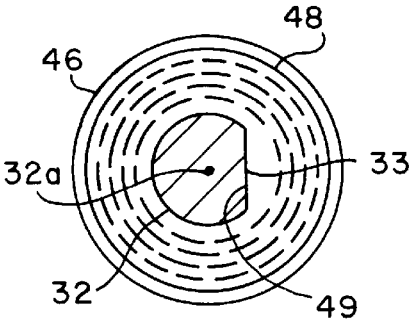
FIG. 8 is a section view taken from line 8—8 of FIG. 2.

Counterbalancing torque is exerted on the respective cable drums 38 and 40 by opposed torsion coil type counterbalance springs 46 and 46' which are of conventional construction. As shown in FIG. 2, each of the springs 46 and 46' is connected at one end to a somewhat frustoconical shaped hub member 48 having a spiral groove 50 formed thereon and of a configuration to forcibly engage one or more coils 46*a* of the springs 46 and 46', respectively, in such a way that the springs are nonrotatably connected to the hubs 48. Referring briefly to FIG. 8, the cross sectional configuration of the shaft 32 is substantially circular except for a flat surface 33 formed thereon in such a way as to give the shaft somewhat the appearance of the letter "D", actually a backward "D" as shown. In like manner the hub members 48 have a corresponding "D" shaped bore 49 formed therein. The hub members 48 are thus nonrotatable relative to the shaft 32 but are axially slidable thereon to accommodate a change in the axial length of the springs 46 and 46' as they undergo torsional deflection in opposite directions with respect to the longitudinal central axis 32*a* of shaft 32. The hub members 48 may be formed of a self-lubricating polymeric material, for example.

Figure 4:
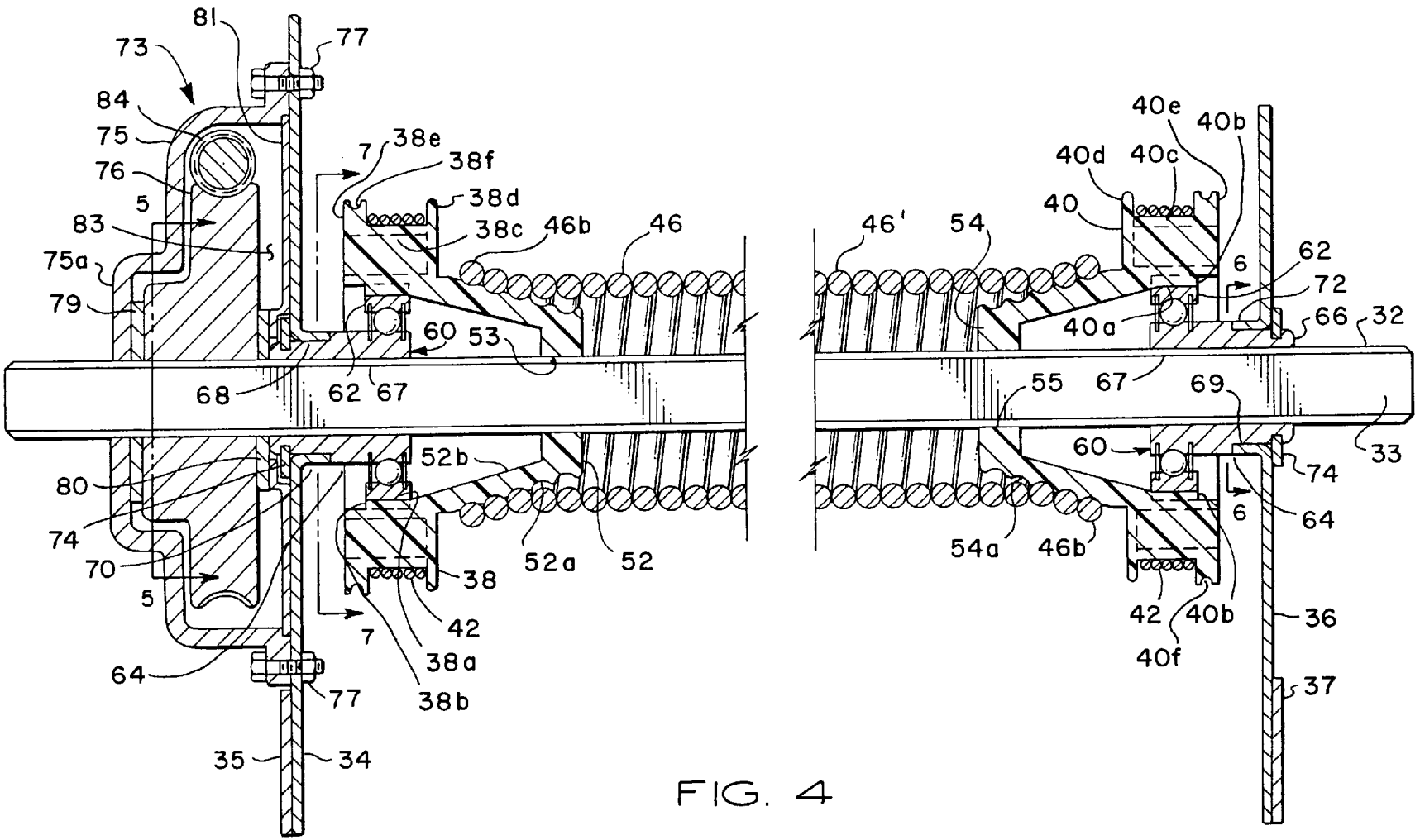
FIG. 4 is a detail longitudinal central section view on a larger scale showing the mounting of the cable drums and the shaft drive mechanism.

The opposite ends of the springs 46 and 46' are similarly secured to hub members 52 and 54, respectively, FIG. 2 and FIG. 4, which, in turn, are secured for rotation with the cable drums 38 and 40. Each of the hub members 52 and 54 includes a spiral groove portion 52*a* and 54*a* formed on the outer surface thereof in a manner similar to formation of the grooves 50 for receiving and forcibly engaging the end coils 46*b* of the torsion springs 46, and 46' as shown in FIG. 2. The springs 46 and 46' are thus secured to the hub members 48 and 52 and to the hub members 48 and 54, respectively, and the end coils 46*a* and 46*b* are nonrotatable with respect to the hub members to which they are connected.

Figure 7:
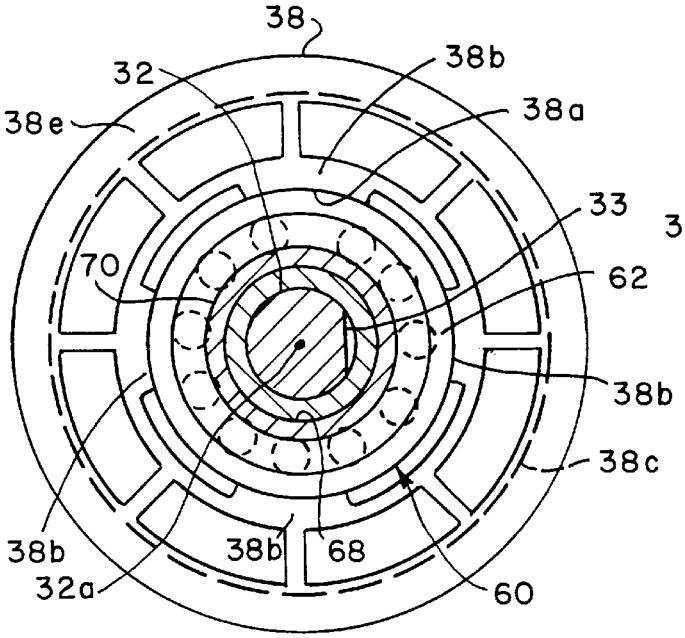
FIG. 7 is a section view taken from line 7—7 of FIG. 4.

Referring now to FIG. 4, it will be noted that the hub members 52 and 54 are provided with suitable bores, 53 and 55, respectively, to provide clearance for the shaft 32 so that the hub members 52 and 54 may rotate with the cable drums 38 and 40, respectively, and with respect to the shaft 32. As shown in FIG. 4, the hub member 52 is formed as an integral part of the cable drum 38 and includes a somewhat frustoconical body portion 52*b* integrally joined with the cable drum 38. The cable drum 38 includes a bearing bore 38*a* formed by circumferentially spaced axially extending parallel finger portions 38*b,* see FIG. 7 also. The cable drum 38 also includes a circumferential rim 38*c* and opposed circumferential flanges 38*d* and 38*e*. The flange 38*e* includes a suitable circumferential cable retention groove 38*f*. The flanges 38*d* and 38*e* confine the wraps of cable 42 wound on drum 38, as shown.

In like manner, the hub member 54 is preferably integrally formed with the cable drum 40 and the combined hub member and cable drum may be virtually identical to the combined hub member 52 and cable drum 38. For example, the cable drum 40 includes axially extending circumferentially spaced finger portions 40*b* defining a bearing bore 40*a*. A circumferential rim 40*c* supports wraps of cable 42 between opposed flanges 40*d* and 40*e,* as shown in FIG. 4. A cable retention groove 40*f* is also formed on flange 40*e*. The cables 42 are secured to the respective drums 38 and 40, such as by providing suitable beckets, not shown, secured to the ends of the respective cables 42 and disposed in suitable retention slots formed in the respective cable drums 38 and 40. The combined cable drums and hub members 38, 52 and 40, 54 described hereinabove may be integrally formed such as of molded high strength polymeric material, for example. Alternatively, the aforementioned combination hub and cable drum elements can be formed of cast or machined metal, also.

The cable drums 38 and 40 are advantageously supported for rotation on the shaft 32 by rolling element bearings 60, respectively. The bearings 60 are characterized by cylindrical outer race members 62 suitably forced fitted in the bearing bores 38*a* and 40*a* and the bearings 60 are also each characterized by an inner race member 64 having an axially extending hub portion 66. The hub portions 66 project through bores 68 and 69 defined by axially projecting circular flange portions 70 and 72 formed on the brackets 34 and 36, respectively. The bearing hub portions 66 each include a suitable circumferential groove for supporting a retaining ring 74, as shown in FIG. 4, for retaining the bearings 60 secured against axial movement relative to the brackets 34 and 36, respectively. Accordingly, the cable drums 38 and 40 are supported for rotation on the respective bearings 60 and relative to the shaft 32 and this rotation is either augmented or opposed by the torsional effort of the springs 46 and 46' engaged with the respective hub members 52 and 54. The rolling element bearings 60 may be sealed deep groove ball bearings, for example, or other suitable bearing means operable to support the respective cable drums 38 and 40 and for retaining the drums against axial movement with respect to the shaft 32 and the brackets 34 and 36.

Figure 5:
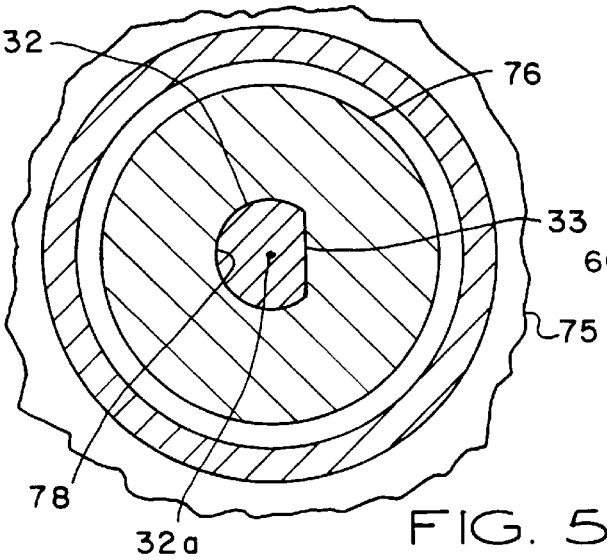
FIG. 5 is a section view taken from line 5—5 of FIG. 4.
Figure 6:
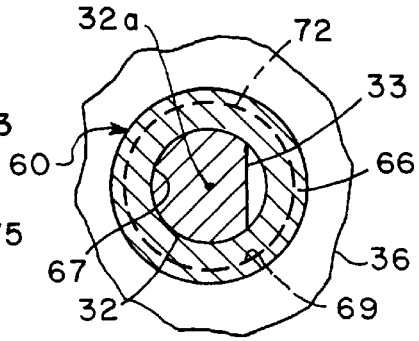
FIG. 6 is a section view taken from line 6—6 of FIG. 4.

Referring further primarily to FIGS. 3, 4 and 5, the counterbalance mechanism 30 includes drive means for rotating the shaft 32 to adjust the torsional deflection of the springs 46, 46' for pretensioning cables 42 to counterbalance the weight of the door 10. The drive means is generally designated by the numeral 73 and comprises a housing 75 supported on the bracket 34 and a ring gear 76 disposed on shaft 32 for rotation therewith and within the housing. The housing 75 is secured to bracket 34 by spaced apart conventional threaded fasteners 77, FIG. 4. The gear 76 has a suitable bore 78 formed therein, FIG. 5, and having a "D" shaped cross section for receiving the shaft 32 and being nonrotatable relative to the shaft. The gear 76 is disposed between spaced apart spacers or thrust bearings 79 and 80, FIG. 4. The thrust bearings 79 and 80 are disposed between the gear 76 and a transverse end wall 75*a* of housing 75 and between gear 76 and a removable housing cover plate 81, respectively. The interior space 83 of housing 75 may be at least partially grease packed at assembly.

The gear 76 is meshed with a worm gear 84 which is mounted in the housing 75 on suitable spaced part sealed bearings 86, FIG. 3. The worm 84 includes a drive shaft portion 88 extending from the housing 75, as shown in FIG. 3, and having a suitable drive member 90 connected thereto such as a hexhead bolt. The bolt 90 may be engaged with a drive socket member suitably drivenly connected to a power tool, such as a conventional hand held electric drill 89 for rotating the worm 84 and the ring gear 76 to rotate the shaft 32 and the hub members 48 to increase or decrease the torsional deflection, otherwise known as winding or unwinding, of the springs 46, 46'.

The geometry of the worm 84 and the gear 76 are predetermined such that the worm 84 may be driven to rotate the gear 76 but the gear cannot be driven to rotate the worm 84. Accordingly, the tendency for the shaft 32 to rotate under a torsional effort exerted by the springs 46, 46' through the hubs 48 is resisted or locked by the drive means 73. However, the drive means 73 may be actuated to rotate the shaft 32 as described above. A preferred geometry of the ring gear 76 and the worm 84 is such that the speed reduction ratio of the gears is about 50:1, that is, the worm 84 rotates fifty revolutions for each revolution of gear 76. The above geometry will provide a worm drive which cannot be driven in the so-called reverse direction by exerting a drive force on the ring gear 76.

The operation of the counterbalance mechanism 30 will now be described. The mechanism 30 may be assembled by sliding the hub members 48 onto the shaft 32 together with the springs 46 and the cable drum members 38 and 40 together with their respective integral hub members 52 and 54. The cable drums 38 and 40 may also be preassembled with the bearings 60, respectively. The inner races 66 of bearings 60 have suitable bores 67 which are preferably dimensioned to allow forced slidable movement along shaft 32. The drum 40 and its bearing 60 may be mounted in the bracket 36 in supportive relationship thereby and the bracket 34, in assembly with the drive means 73, may be mounted on the shaft 32 and then secured to the wall 14 in proper alignment with respect to the bracket 36. The cables 42 are then connected to the drums 38 and 40 at one end, respectively, and to the connectors 44 on the lower panels 16 of the door 10.

After connection of the cables 42 to the drums 38 and 40 and to the door 10 a suitable power tool, such as the conventional electrical drill 89, FIG. 3, with a socket attachment disposed in the chuck, may be connected to the drive shaft 88 by way of the drive member 90 to rotate the worm 84, gear 76, shaft 32 and hubs 48 to torsionally deflect the springs 46, 46' until a desired counterbalance force is exerted on the cable drums 38 and 40 and the respective cables 42 wound thereon. The springs 46, 46' may be wound a predetermined number of revolutions upon taking all slack out of the cables 42, or a suitable tension gauge may be applied to the cables 42 or, a suitable sensor may be connected to the door 10 to indicate when a predetermined counterbalance force is exerted on the door to oppose its weight. The sizing of springs 46 and 46' may, of course, be predetermined for the particular door weight in question. After the predetermined tension is applied to the cables 42 the aforementioned power tool may be removed from the drive member 90 and the shaft 32 will be locked against rotation by the drive means 73 since the gear 76 cannot rotate the worm 84. Normal operation of the door 10 may then be carried out in a known manner. Adjustment of the counterbalance effort of the mechanism 30 may be carried out from time to time, conveniently, by operating the drive means 73 as described above. The direction of rotation of gear 76 can be reversed by driving worm 84 in opposite directions, at will.

Thanks to the location of the drive means 73 on one of the spaced apart support brackets 34 or 36, access to the drive means to adjust the counterbalance force may be obtained at any time including when a garage or other space within the interior of a building and adjacent to the door 10 is occupied. Moreover, the counterbalance mechanism 30 also enjoys the benefits of having two opposed counterbalance springs, as compared with mechanisms utilizing only one counterbalance spring. However, the mechanism 30 is also relatively uncomplicated in construction and operation as compared with prior art counterbalance mechanisms. Those skilled in the art will further appreciate that the arrangement of the counterbalance mechanism 30 may be reversed, that is, the drive means 73 may be located on the right hand side, viewing FIG. 2, of the door 10.

Figure 9:
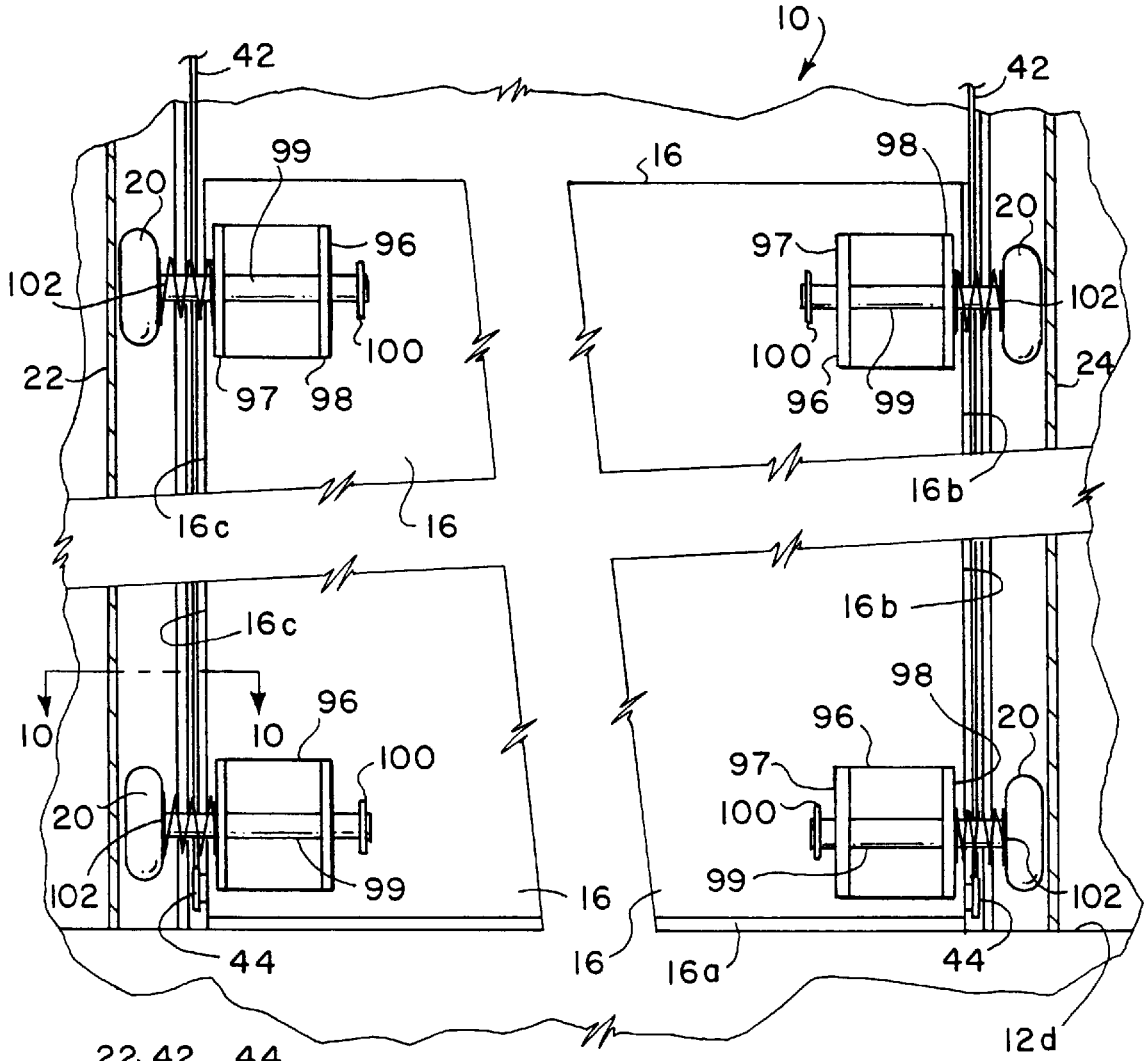
FIG. 9 is a detail elevation of the door shown in FIG. 1 illustrating the improved door centering mechanism.

The door 10 may, under certain conditions, when being raised or lowered, tend to become somewhat skewed due to slight variations in the counterbalance effort of the opposed counterbalance springs, since these springs are operating on their respective cable drums independently. This skewing effort may cause the door to become jammed as the guide members or rollers 20 also become skewed in their opposed guide members or tracks 22 and 24. However, as shown in FIGS. 9 and 10, this problem is overcome with a unique support arrangement for the guide and support members or rollers 20.

In one arrangement of the guide structure for the door 10, opposed sets of rollers 20 are mounted on each of the panels 16 adjacent opposite side edges 16*a* and 16*b* of the panels by suitable, somewhat channel shaped brackets 96 having opposed flanges 97 and 98 including respective bores 97*a* and 98*a* formed therein and which form bearing means to journal respective support shafts 99 for the rollers 20. Each shaft 99 may be retained on its bracket 96 by a removable retaining ring 100 and is axially slidable with respect to the bracket 96, respectively. At least the rollers 20 and their associated support brackets 96 at opposite upper and lower corners of the door 10 are provided with coil compression springs 102 sleeved over the shafts 99 and engaged with flanges 97 or 98, respectively, for biasing the rollers 20 laterally, with respect to movement of the door when it is opened or closed, into engagement with the tracks 22 and 24.

By interposing the springs 102 between the rollers 20 and the support brackets 96, at the four positions shown, or at least at two opposed positions on opposite sides of the door 10, the door tends to be centered between the tracks 22 and 24 during opening and closing movement as well as when the door is stationary in either the open or closed position. In this way, any tendency for the door to skew as a result of differential tensions on the cables 42, and/or an off center activation effort exerted on the door, is overcome by the centering effect of the springs 102. Door opening and closing movement is often uneven due to friction or drag encountered in the door guide mechanism. This unwanted action which also tends to skew and jam the door is also overcome or substantially diminished by the centering springs 102.

Figure 10:
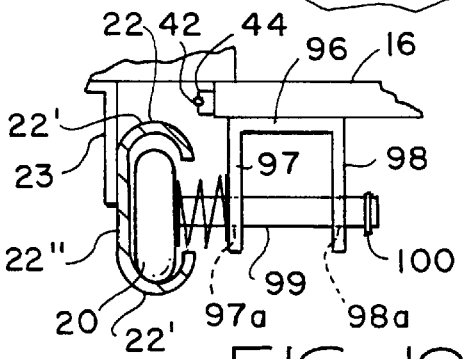
FIG. 10 is a detail section view taken along the line 10—10 of FIG. 9.

As shown in FIG. 10, the opposed arcuate flanges 22' of the track 22 may be proportioned such that these flanges engage the periphery of the rollers 20 and minimize the tendency for the rollers to engage the web 22" of the track 22 thereby reducing friction between the rollers and the track as the doors move between open and closed positions. The track 24 may be essentially a mirror image of track 22 and the rollers 20 engaging the track 24 undergo the same positioning to prevent engagement of the web portion of the track 24. Those skilled in the art will recognize that the guide members or rollers 20 may have other configurations such as slide members which engage other types of track or door guide and support structures, including cylindrical tubes wherein the guide members may be characterized by somewhat arcuate clip members, also each supported on a shaft similar to the shafts 99.

Figure 12:
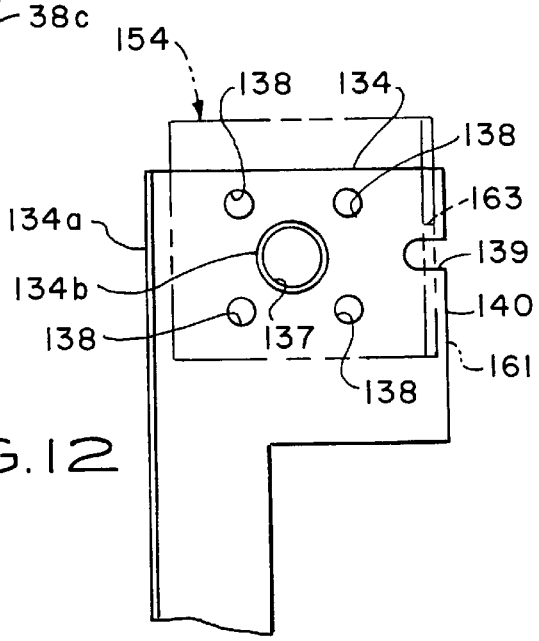
FIG. 12 is a detail elevation view of one of the counterbalance shaft support brackets of the embodiment shown in FIG. 11.
Figure 11:
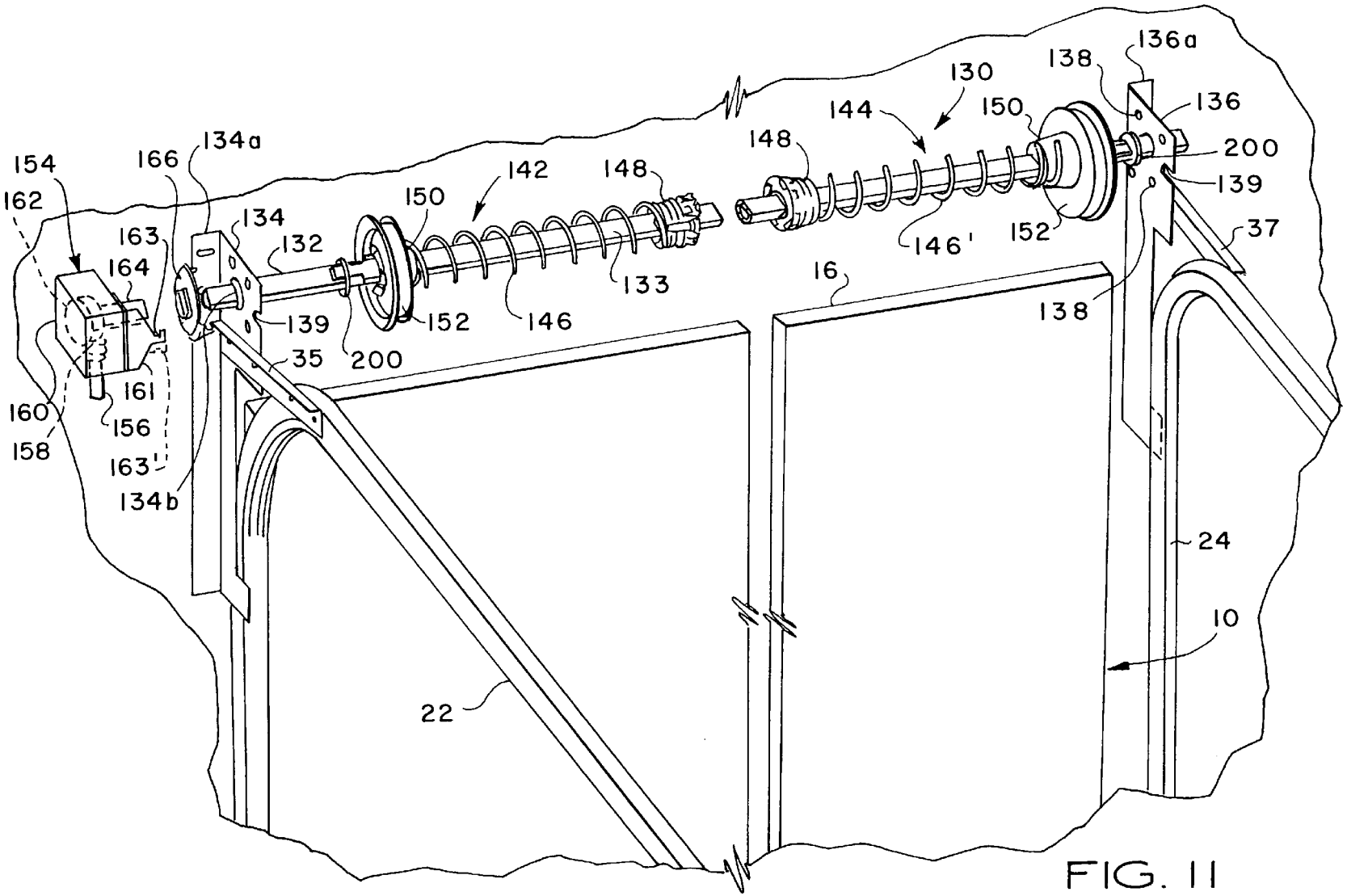
FIG. 11 is a perspective view of an alternate embodiment of a counterbalance mechanism in accordance with the present invention.

Referring now to FIG. 11, another embodiment of a counterbalance mechanism for the door 10 is illustrated and generally designated by the numeral 130. The counterbalance mechanism 130 includes an elongated noncircular, "D" cross section shaft 132 having a flat surface 133 and similar to the shaft 32 but having a hollow tubular configuration. The shaft 132 is adapted to be supported by spaced apart support brackets 134 and 136 which are similar in construction and may be formed from the same stamping, for example, by having their respective support flanges 134*a* and 136*a* formed by bending the flange portion in opposite directions to form the respective brackets. As shown in FIG. 12, by way of example, the support bracket 134 includes a cylindrical bore 137 formed therein and defined by a flange 134*b* for receiving the shaft 132. Four spaced apart holes 138 are formed in bracket 134 in a bolt circle pattern about the bore 137. Still further, the bracket 134, as well as the bracket 136, is provided with a recess or notch 139 formed in a vertical side edge 140 spaced from the flange 134*a* or 136*a,* respectively.

Opposed counterbalance spring assemblies 142 and 144 are supported on the shaft 132 and comprise respective torsion coil springs 146 and 146' which are connected at one end to hub members 148 adapted to rotate with the shaft 132. The springs 146, 146' are connected to respective hub members 150 at their opposite ends, which hub members are supported on and adapted to rotate with respective cable drums 152. The cable drums 152 are shown spaced from their normal working positions in the illustration of FIG. 11 for clarity and the working positions of the cable drums 152 will be described further herein by way of example with regard to FIG. 16. In like manner, the cables 42 are not shown in FIG. 11, although cables are wound on the drums 152 in the same manner that the cables 42 are wound on the drums 38 and 40.

Referring further to FIG. 11, the counterbalance mechanism 130 includes a detachable worm gear drive assembly 154, similar in some respects to the worm gear drive assembly 73, having an input shaft 156 suitably secured to a worm 158 mounted for rotation in a housing 160 and meshed with a ring gear 162 also mounted in the housing 160 for rotation therein. The ring gear 162 is suitably secured to a "D" cross section shaped output shaft 164, FIG. 11, which is operable to be fitted in driving engagement within either end of the tubular shaft 132. The drive assembly 154 may be connected in driving engagement with the shaft 132 and, in response to rotation of the input shaft 156, the shaft 132 may be rotated to wind the torsion coil springs 146 and 146'. In this regard, the housing 160 is provided with a flange 161 projecting therefrom and having a hook portion 163 formed thereon and operable to be engaged with the bracket 134 at the recess or notch 139 to prevent rotation of the drive assembly 154 when the shaft 132 is being rotated to change the torsional windup of the springs 146 and 146'.

The flange 161 may also include a hook portion 163' facing the opposite direction for engagement with the notch 139 of bracket 136. Accordingly, the drive assembly 154 may be mounted on either one of the support brackets 134 or 136 with the hook 163 or 163' engaged with the brackets at the notches 139, respectively, whereupon a suitable drive tool, such as the tool 89, may be connected to the shaft 156 to rotate shaft 132 to adjust the torsional windup of springs 146, 146' until a desired counterbalance effort is applied to the door 10 through the cables wound on the drums 152.

In order to maintain the shaft 132 in a stationary position after the appropriate torsional windup has been applied to the springs 146 and 146', a unique lock plate 166, see FIGS. 11 and 13 through 16, is provided which is sleeved over the shaft 132 between the bracket 134 and the drive assembly 154, for example, when the drive assembly is mounted on the shaft and the bracket. The lock plate 166 is operable to engage the bracket 134 to lock the shaft 132 in a predetermined rotative position with respect to the bracket once the torsional windup of the springs 146 and 146' has been applied.

Figure 13:
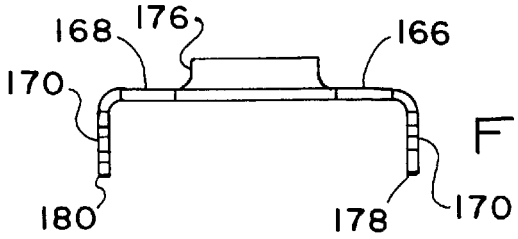
FIG. 13 is a top plan view of a lock plate for the counterbalance mechanism shown in FIG. 11.
Figure 14:
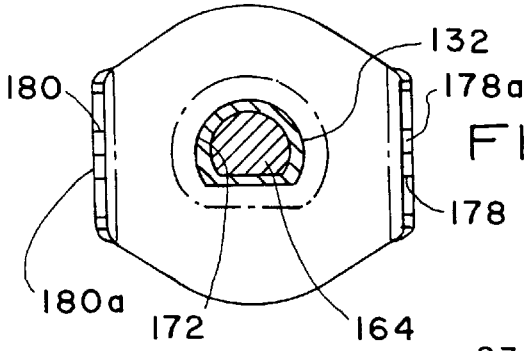
FIG. 14 is a front elevation of the lock plate shown in FIG. 13.
Figure 15:
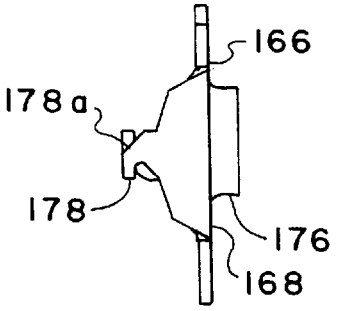
FIG. 15 is a side elevation of the lock plate showing the opposed hook portions.

Referring to FIGS. 13 through 15, the lock plate 166 includes a generally planar body portion 168 and opposed transverse flange portions 170 extending generally normal to the body portion 168. The body portion 168 includes a noncircular, "D" shaped bore 172 formed therein, as shown in FIG. 14, for receiving the shaft 132 nonrotatable relative to the lock plate. For the sake of clarity, the drive shaft 164 is shown in FIG. 14 inserted within the tubular shaft 132, see also FIG. 16. The bore 172 is formed, in part, by a collar portion 176 extending normal from the planar body portion 168 in a direction opposite to the flanges 170.

The flanges 170 include hook portions 178 and 180 formed thereon, respectively, and operable to be engaged with the bracket 134 when inserted in the spaced apart holes 138. As shown by way of example, the hook portions 178 and 180 are spaced in such a way that two holes 138 opposed at 180° will receive the hook portions when the shafts 132, 164 are rotated to an appropriate position such that the hook portions may be inserted in the holes and engaged with the bracket 134 once the shaft 132 has been rotated to a predetermined position such that the counterbalance springs 146 and 146' are exerting a sufficient counterbalance effort on the door 10.

Accordingly, with the counterbalance mechanism 130 assembled to the door 10 and with the cable drums 152 in their working positions, the lock plate 166 may be mounted on the distal end of the shaft 132 which is projecting through the bracket 134 and the drive assembly 154 may then be mounted to the bracket 134 with the shaft 164 extending in the end of the tubular shaft 132. In this condition, the lock plate 166 is not engaged with the bracket 134 at the respective hook portions 178 or 180. The length of the flange 161 is sufficient to allow a space between the housing 160 and the bracket 134 so that the lock plate 166 is not required to be engaged with the bracket, although the hook 163 is engaged with the bracket when the drive assembly 154 is actuated.

The springs 146 and 146' are then wound by rotating the shaft 132 with the drive assembly 154 until a predetermined counterbalance effort is obtained. At this time, if the lock plate 166 is aligned with opposed sets of holes 138 so that the hook portions 178 and 180 may be inserted therein, the lock plate is moved along the shaft 132 into engagement with the bracket 134. If the position of the lock plate 166 requires incremental rotation of the shaft 132, this is accomplished by the drive assembly 154 until the hook portions 178 and 180 may be moved into the holes 138. Once the lock plate 166 is in a position as just described, the drive assembly 154 is rotated in the opposite direction a small amount until the hook portions 178 and 180 engage the bracket 134 and torsion is relieved on the drive shaft 164 so that the housing 160 may be rotated slightly to allow removal of the hook 163 from engagement with the bracket 134 at the notch or recess 139. The lock plate 166 may be modified to have the hook portions 178 and 180 facing opposite to that shown whereby the lock plate may be mounted on bracket 136 instead.

Of course, if counterbalance adjustment is required at a later time, the drive assembly 154 is remounted on the bracket to which the lock plate is connected and the counterbalance adjustment may be accomplished by rotating the shaft 132 in a clockwise direction, viewing FIGS. 11 and 12, for example. In this situation, opposed cam surfaces 178*a* and 180*a* on the lock plate 166, FIGS. 14 and 15, will engage the bracket 134 causing the lock plate to move axially along the shaft 132 out of its locking position to thereby prevent any damage to the drive assembly 154, the lock plate or the shaft 132. Again, once the proper adjustment has been made, the lock plate 166 is re-engaged with the bracket 134 (or 136) in the manner described above.

Figure 16:
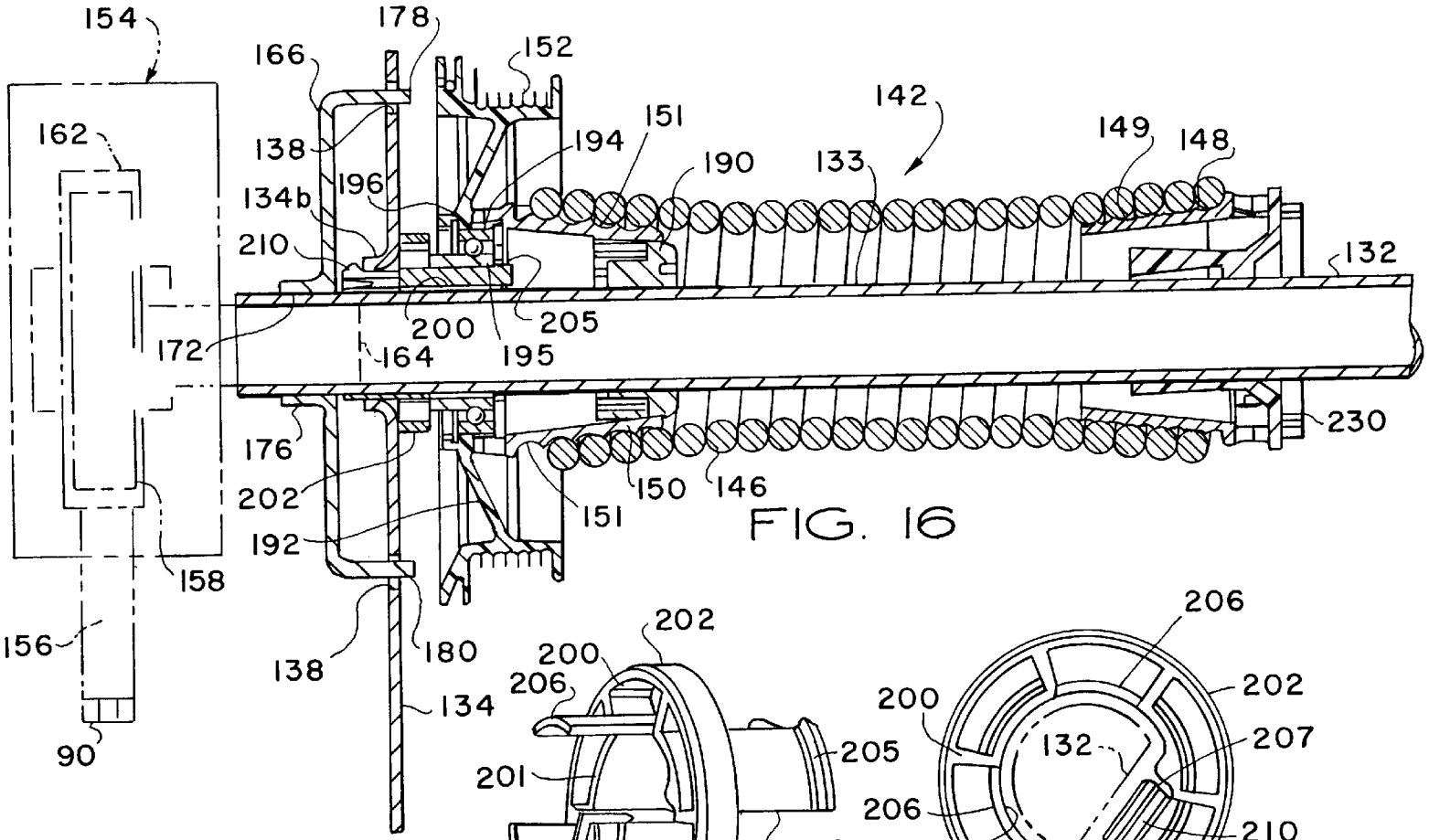
FIG. 16 is a detail section view of one of the counterbalance drum and spring assemblies of the embodiment shown in FIG. 11.

Referring now to FIG. 16, in particular, one of the torsion spring assemblies, represented by the spring assembly 142, is illustrated in further detail. The spring assembly 144 is essentially identical. The cable drum 152 is similar to the drums 38 and 40 and hub portion 150 may be an integral part of the drum or a separate member suitably secured to the drum. As shown in FIG. 16, the hub portion 150 includes suitable spiral grooves 151 for receiving end coils of either the torsion spring 146 or 146'. A suitable end cap 190 is secured to the hub 150 for supporting the end of the hub opposite the cable drum 152. The drum 152 includes a suitable generally circular web portion 192 supported by a bearing assembly 194, similar to the bearing assembly described for the drums 48 and 40 and mounted in a hub 196 connected to or integral with web portion 192.

Figure 18:
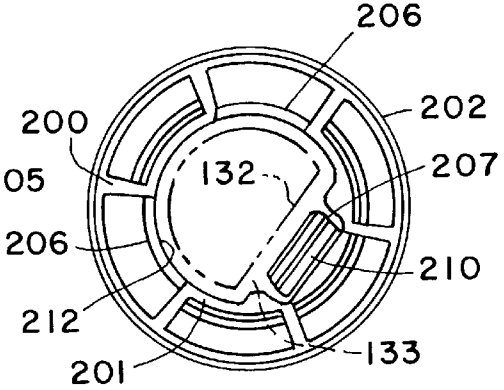
FIG. 18 is an end view of the bushing shown in FIG. 17.
Figure 17:
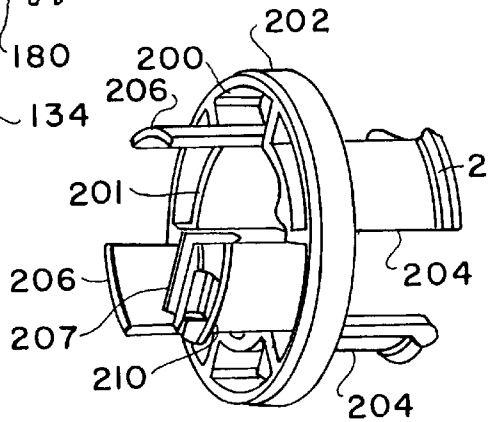
FIG. 17 is a perspective view of a support bushing for the cable drum of the embodiment shown in FIG. 16.

Referring further to FIGS. 16, 17 and 18, a support bushing 200, see FIGS. 17 and 18, is provided for the cable drums 152, respectively, and is characterized by a hub portion 201, a cylindrical collar 202 supported thereon and opposed sets of resiliently deflectable fingers 204 and 206 projecting axially from opposite sides of hub portion. The axially projecting fingers 204 include radially projecting flange portions 205 formed on the distal ends of the fingers 204, respectively. The fingers 204 may be inserted in a bore 195, FIG. 16, of the bearing assembly 194 wherein the elastically deflectable fingers then snap into locked engagement with the bearing assembly when the flange portions 205 extend through the bearing assembly as shown in FIG. 16.

Referring also to FIG. 18, one of the fingers 206 projecting in an axial direction opposite from the fingers 204 is provided with a radially projecting flange portion 210, see FIGS. 16, 17 and 18, and the configuration of the bushing 200 is such that a somewhat D shaped cross section bore 212 is formed in the hub portion 201 for receiving the shaft 132, as indicated in FIG. 18. The fingers 206 are adapted to project into the bore 137 formed in the bracket 134 or 136 and the finger 206 bearing the radially projecting boss 210 is deflected until the boss snaps into position in engagement with the bracket flange 134*b* to prevent axial displacement of the cable drum 152 along the shaft during operation thereof. However, with the shaft 132 removed from the bushing 200, the fingers 204 and 206 may be deflected radially inwardly with respect to a central axis of the bushing to remove the bushing from the drum 152 and/or the bracket 134 or 136, as desired. The collar 202 provides for spacing the cable drum 152 a predetermined distance from the bracket 134 or 136.

Figure 19:
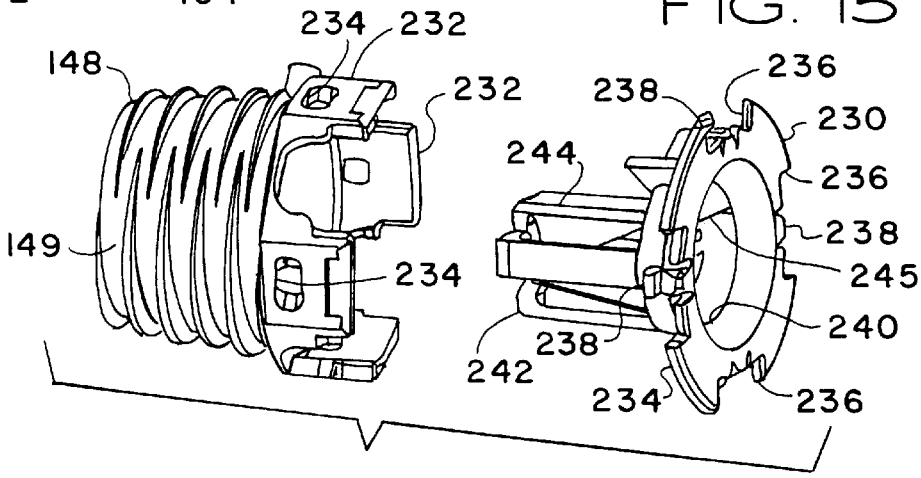
FIG. 19 is an exploded perspective view of a bushing and hub assembly for the embodiment of the invention shown in FIGS. 11 and 16.
Figure 20:
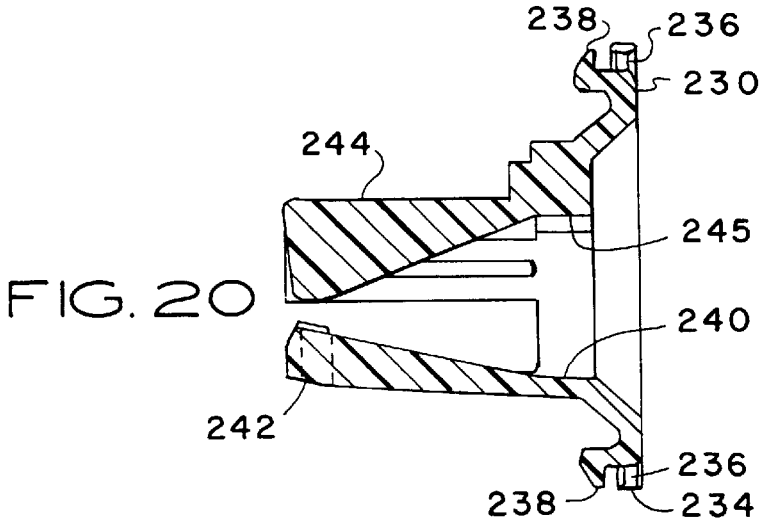
FIG. 20 is a longitudinal section view of the bushing for the hub assembly shown in FIG. 19.

Referring further to FIG. 16 and also FIGS. 19 and 20, each of the spring hub members 148 is provided with suitable spiral grooves 149 for forcible engagement with end coils of the springs 146 or 146', respectively. The hubs 148 are also advantageously formed as generally frustoconical hollow members each having a unique support bushing, preferably fabricated to be detachable from the hubs. The support bushing is illustrated and generally designated by the numeral 230 in FIG. 16 and is shown in further detail in FIGS. 19 and 20.

Referring primarily to FIGS. 19 and 20, each hub 148 includes plural circumferentially spaced and axially projecting bosses 232 formed thereon and having radially extending recesses 234 formed therein, respectively. The hub support bushing 230 is characterized by a circumferential, generally cylindrical transverse flange portion 234 having circumferentially spaced recesses 236 formed therein for receiving the bosses 232. Resilient, radially deflectable projections 238 are disposed in the recesses for engagement with the bosses 232 and registration with the respective recesses 234 formed in the bosses. The flange 230 is formed with a circular segment or "D" shaped bore 240 formed therein and from which project resiliently deflectable axially extending fingers 242 and 244. Three fingers 242 are formed and are spaced circumferentially about the bore 240 at 90° intervals. The fourth finger 244 is aligned with a generally flat surface 245 of the bore 240 defining the "D" shaped cross section. The bushing 230 may be formed as a part separate from the hub member 148 and snapped into assembly with the hub member by deflecting the projections 238 until they snap into the recesses 234 formed in the bosses 232. When the shaft 132 is inserted in the bore 240, the fingers 242 and 244 are deflected but are retained in forcible engagement with the shaft 132 so that the hub 148 is snugly supported on and nonrotatable relative to the shaft but axially slidable on the shaft as the torsion springs connect thereto tend to lengthen or shorten axially as the torsion windup of the springs is varied.

By forming the hubs 148 and the bushings 230 as separate members, different size shafts and different diameters of torsion springs may be used with different combinations of hub members and support bushings, for example. In this way, the hubs 148 and support bushings 230 may be formed in different dimensional configurations and interchanged in the field such that a hub assembly of the proper size to accommodate a particular dimensional configuration of shaft 132 and a particular dimensional configuration of a torsion spring 146 or 146' may be obtained. This advantage is also enjoyed by the bushing 200 since different size bushings may be utilized in conjunction with a particular size cable drum 152 and bearing assembly 194. Moreover, the bushings 200 and 230 may be easily replaced if they become worn. The bushings 200 and 230 are preferably formed of molded polymeric material such as glass reinforced nylon.

Figure 21:
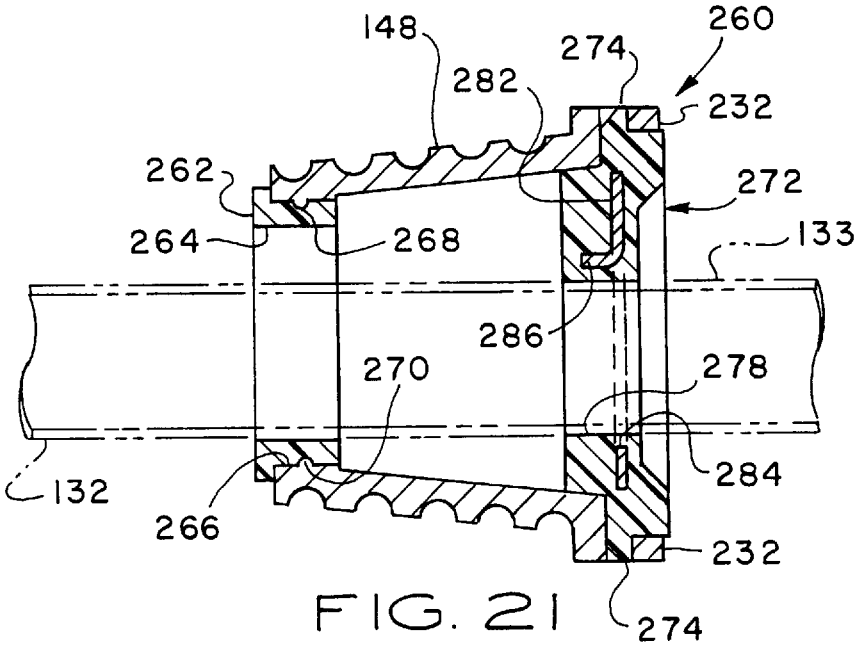
FIG. 21 is a section view taken along the line 21—21 of FIG. 22 of another embodiment of a bushing and hub assembly.
Figure 22:
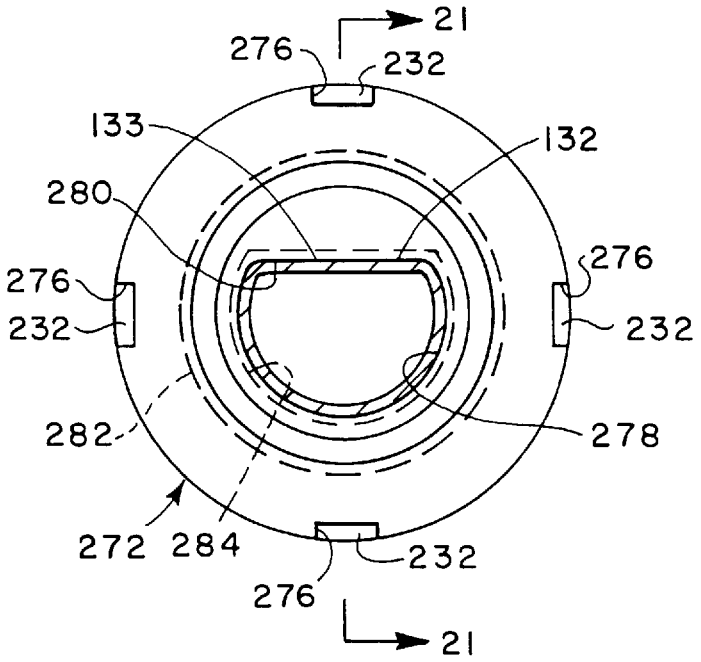
FIG. 22 is an end view of the bushing and hub assembly shown in FIG. 21.

Referring now to FIGS. 21 and 22, another embodiment of a spring support hub and bushing assembly is illustrated and generally designated by the numeral 260. The hub and bushing assembly 260 includes the spring hub member 148 which is adapted to receive a first bushing member 262 at the end of the hub member opposite the axially projecting bosses 232. The hub support bushing 262 is preferably formed of a polymer, such as nylon, and has a generally cylindrical bore 264 formed therein for receiving the tubular shaft 132. The diameter of the bore 264 is preferably slightly greater than the diameter of the shaft 132 and the bushing 262 may be adapted for a slight interference or snap fit into a bore 266 of the hub 148. A generally cylindrical bushing retention key or boss portion 268 may be formed in the bore 266 for registration with a corresponding recess 270 formed in the bushing 262 for retaining the bushing connected to the hub 148.

The opposite end of the bushing and hub assembly 260 is adapted to include a generally cylindrical bushing 272 also formed of a polymer material, such as nylon. The bushing 272 is also provided with plural circumferentially spaced deflectable projections 274, two shown in FIG. 21, adjacent corresponding recesses 276. Accordingly, the bushing 272 is operable to be releasably connected to the hub 148 in the same manner as the bushing 230. However, the bushing 272 is formed with a circular segment bore 278 dimensioned to be slightly larger than the shaft 132 so that the shaft 132 may be slidably received in the bore but non-rotatable relative thereto. The bore 278 includes a generally planar or flat surface 280 operable to register with the corresponding flat or planar surface 133 on the shaft 132. Moreover, the bushing 272 is preferably provided with a metal reinforcement or core piece 282 comprising a generally cylindrical metal plate with a circular segment bore 284 formed therein and a laterally projecting reinforcing key or tang portion 286, see FIG. 21. The molded-in-place plate 282 provides reinforcement for bushing 272 to minimize any tendency for the bushing to be rounded out by the shaft 132. Those skilled in the art will appreciate that the bushing 272 may be replaced by similar bushings having different shaft bore diameters or configurations without replacing the hub 148 or the bushing 262. In fact, for the bushing assembly 260, any one of the three main components, that is the hub 148, the bushing 262 and the bushing 272 may be replaced without replacing the other two components.

The assembly, disassembly and operation of the counterbalance mechanisms 30 and 130 and the door 10 is believed to be within the purview of one skilled in the art from the foregoing description. Moreover, the counterbalance mechanisms 30 and 130 may be constructed using conventional engineering materials such as molded and machined metal and polymeric materials commonly used for garage door counterbalance mechanisms and the like. Although preferred embodiments of the invention have been described in detail herein, those skilled in the art will also recognize that various substitutions and modifications may be made to the invention without departing from the scope and spirit of the appended claims.

What is claimed is:

1. A counterbalance mechanism for a vertical opening door for counterbalancing at least part of the weight of said door when said door is moved between open and closed positions, said mechanism comprising:

spaced apart bracket means disposed generally above and adjacent to said door;

a single elongated shaft means extending between and supported on said bracket means;

spaced apart torsion spring means each operably connected to said shaft means at one end, respectively, and non-rotatable relative to said shaft means;

opposed cable drums mounted on bearing means supported on said shaft means, respectively, between said bracket means, respectively, and connected to the other ends of said torsion spring means, respectively, said cable drums each being rotatable relative to said shaft means, and said cable drums having flexible cables wound thereon and connected at a free end depending from said cable drums to said door, respectively; and drive means operably connected to one end of said shaft means adjacent one of said bracket means for rotating said shaft means in one direction, at will, to adjust the torsional deflection of said torsion spring means to provide a counterbalance force exerted by said cables, said drive means including a housing mounted on said one bracket means and supporting means operable to prevent rotation of said shaft means in an opposite direction in response to a torsional effort exerted on said shaft means by said torsion spring means.

2. The mechanism set forth in claim 1 wherein:

said drive means includes one way drive gear means drivably connected to said shaft means and to means for rotating said one way drive gear means to adjust the deflection of said torsion spring means, respectively.

3. The mechanism set forth in claim 2 wherein:

said drive means comprises a worm gear drive assembly including a ring gear drivingly connected to said shaft means and a worm meshed with said ring gear and including a drive portion for rotating said worm at will.

4. The mechanism set forth in claim 1 including:

opposed hub members mounted on said shaft means for axial sliding movement thereon and connected to said torsion spring means, respectively, said hub members including respective bores for receiving said shaft means and including means for engagement with said shaft means for rotation therewith.

5. The mechanism set forth in claim 4 wherein:

said shaft means comprises one of a solid member and a tubular member having a non-circular cross section including a generally planar surface formed thereon and cooperable with corresponding non-circular bores formed in said hub members, respectively.

6. The mechanism set forth in claim 1 wherein:

said door is supported by spaced apart guide members for movement between open and closed positions and said door is connected to said guide members by plural spaced apart guide means engageable with said door along opposite sides thereof and with said respective guide members, and said door includes resilient means interposed between respective ones of said guide means and said door for substantially centering said door between said guide members during movement of said door between open and closed positions under urging of said cables, to substantially prevent skewing of said door with respect to said guide members.

7. The mechanism set forth in claim 6 wherein:

said resilient means comprise coil springs interposed between said guide means and said door at spaced apart points on opposite sides of said door, respectively.

8. A counterbalance mechanism for a vertical opening, sectional garage door for counterbalancing at least part of the weight of said door when said door is moved between open and closed positions, said mechanism comprising:

spaced apart brackets disposed generally above and adjacent to said door;

an elongated shaft extending between said brackets and supported by said brackets, respectively;

a pair of opposed hub members disposed on said shaft for rotation therewith;

opposed torsion coil springs disposed around said shaft and each connected at one end to said hub members, respectively;

opposed cable drums supported on said shaft spaced apart, said cable drums being connected to respective hub portions engaged with opposite ends of said torsion springs, respectively, each of said cable drums being supported on bearing means for rotation relative to said shaft and operable to deflect said torsion springs, respectively;

elongated, flexible cable members disposed around said cable drums, respectively, and having depending free ends connected to opposite sides of said door; and a drive mechanism connected to said shaft adjacent to one side of said door, said drive mechanism including cooperating gears operable to selectively rotate said shaft to deflect said torsion springs, respectively, to exert a counterbalance torque on said cable drums to tension said cables to counterbalance at least part of the weight of said door, one of said gears having drive means connected thereto for rotating said gears to rotate said shaft, at will, to adjust the counterbalance torque exerted by said springs on said cable drums, respectively.

9. The mechanism set forth in claim 8 wherein:

said drive gears include a generally cylindrical ring gear supported on and connected to said shaft for rotation therewith and a worm cooperable with said ring gear for drivably rotating said ring gear and said shaft to adjust the deflection of said torsion springs, respectively.

10. The mechanism set forth in claim 9 wherein:

said drive gears are disposed in a housing supported on one of said brackets.

11. The mechanism set forth in claim 10 wherein:

said worm includes a shaft extension disposed exterior of said housing and adapted to be drivenly engaged by tool means for rotating said worm to rotate said ring gear and said shaft to adjust the deflection of said torsion coil springs, respectively.

12. The mechanism set forth in claim 8 wherein:

said cable drums are integrally formed with said hub portions, respectively, and said cable drums include respective bearing bores for receiving rolling element bearing assemblies for supporting said cable drums for rotation relative to said shaft.

13. The mechanism set forth in claim 12 wherein:

said bearing assemblies include inner race members, respectively, having respective bores for receiving said shaft and means connected to said inner race members for retaining said bearing assemblies against movement relative to said brackets, respectively.

14. The mechanism set forth in claim 13 wherein:

said brackets each include circumferential flange portions engageable with said inner race members of said bearing assemblies, respectively, for supporting said bearing assemblies and said shaft on said brackets, respectively.

15. The mechanism set forth in claim 12 wherein:

said cable drums and said hub portions are formed of a molded polymer material.

16. The mechanism set forth in claim 12 wherein:

said cable drums include circumferentially spaced apart axially projecting finger portions defining said bearing bores, respectively, for supporting said bearing assemblies therein.

17. The mechanism set forth in claim 8 wherein:

said shaft includes a non-circular cross section having a generally flat surface formed thereon and cooperable with corresponding non-circular bores formed in said hub members and one of said gears, respectively.

18. A counterbalance mechanism for counterbalancing at least part of the weight of a vertical opening sectional garage door when moving said door between open and closed positions, said mechanism comprising:

opposed spaced apart wall brackets adapted to be disposed generally above and adjacent to said door;

an elongated shaft extending between and supported by said brackets, respectively;

opposed hub members disposed on said shaft and engageable with said shaft for rotation therewith, said hub members being axially slidable on said shaft;

opposed torsion coil springs disposed around said shaft and each connected at one end to said hub members, respectively;

opposed cable drums spaced apart from each other, said cable drums each being connected to respective hub portions engaged with opposite ends of said torsion springs, respectively, each of said cable drums being supported on a bearing assembly and providing for rotation of said cable drums relative to said shaft in response to deflection of said torsion springs, respectively;

bushing means interconnecting said cable drums with said brackets, respectively;

elongated flexible cable members disposed around said cable drums, respectively, and having depending free ends connected to said door, respectively; and a drive mechanism mountable on one of said brackets including a housing, gear means mounted in said housing for rotation in response to a drive force means, said gear means being operable to be connected to said shaft for rotating said shaft to deflect said torsion springs in response to rotation of said gear means for adjusting a counterbalance torque exerted on said cable drums to tension said cables for counterbalancing at least part of the weight of said door.

19. In a counterbalancing mechanism for a vertical opening door for counterbalancing at least part of the weight of said door when said door is moved between open and closed positions, spaced apart bracket means disposed generally above and adjacent to said door, elongated shaft means extending between and supported on said bracket means, torsion spring means operably connected to said shaft means and opposed cable drums disposed around said shaft means and connected to one end of said torsion spring means, respectively, and having flexible cables wound thereon and connected at a free end to said door, and the improvement characterized by:

bearing means disposed on said shaft for supporting said cable drums, respectively, and bushings operable to be detachably connected to said bearing means, respectively, said bushings each including means forming a bore for receiving said shaft and for engaging said shaft to prevent rotation of said bushing relative to said shaft.

20. The invention set forth in claim 19 wherein:

said bushing includes axially projecting fingers engageable with said bearing means, at least one of said fingers having a flange portion formed thereon for engagement with said bearing means to releasably lock said bushing to said bearing means.

21. The invention set forth in claim 19 wherein:

said bushing includes axially projecting finger portions engageable with said bracket means, at least one of said finger portions having a boss formed thereon for releasably engaging said bracket means to retain said bushing and said cable drum in a predetermined position with respect to said bracket means.

22. The invention set forth in claim 21 wherein:

said bushing means includes a hub portion having a noncircular cross section bore for receiving said shaft means and for supporting said bushing on said shaft means nonrotatably relative to said shaft means.

23. The invention set forth in claim 22 including:

a collar formed on said bushing for spacing said cable drum a predetermined distance from said bracket means.

24. A counterbalance mechanism for a vertical opening door for counterbalancing at least part of the weight of said door when said door is moved between open and closed positions, said mechanism comprising:

spaced apart bracket means disposed generally above and adjacent to said door;

elongated shaft means extending between and supported on said bracket means;

torsion spring means operably connected to said shaft means;

opposed cable drums disposed on said shaft means and connected to one end of said torsion spring means, respectively, said cable drums having flexible cables wound thereon and connected at a free end depending from said cable drums to said door, respectively;

drive means including one way drive gear means drivably connected to said shaft means adjacent one of said bracket means for rotating said shaft means in one direction, at will, to adjust the torsional deflection of said torsion spring means to provide a counterbalance force exerted by said cables, said drive means including means operable to prevent rotation of said shaft means in an opposite direction in response to a torsional effort exerted on said shaft means by said torsion spring means, said drive gear means being connected to means for rotating said drive gear means to adjust the deflection of said torsion spring means, respectively, said drive means including a housing detachably mountable on one of said bracket means and including a portion engageable with said one of said bracket means; and a lock member engageable with said shaft means and with said one of said bracket means for retaining said shaft means stationary with respect to said one of said bracket means upon removal of said drive means from said one of said bracket means.

25. The mechanism set forth in claim 24 wherein:

said lock member is supported on said shaft means between said one of said bracket means and said drive means and is axially slidable on said shaft means to a position in engagement with said one of said bracket means.

26. The mechanism set forth in claim 25 wherein:

said lock member includes opposed hook portions engageable with corresponding portions of said one of said bracket means.

27. The mechanism set forth in claim 26 wherein:

said lock member includes cam surfaces formed thereon for engagement with said one of said bracket means to cause said lock member to disengage from said one of said bracket means in response to rotation of said shaft means in one direction with respect to said one of said bracket means.

28. A counterbalance mechanism for a vertical opening door for counterbalancing at least part of the weight of said door when said door is moved between open and closed positions, said mechanism comprising:

spaced apart bracket means disposed generally above and adjacent to said door;

elongated shaft means extending between and supported on said bracket means;

torsion spring means operably connected to said shaft means;

opposed cable drums disposed on said shaft means and connected to one end of said torsion spring means, respectively, said cable drums having flexible cables wound thereon and connected at a free end depending from said cable drums to said door, respectively, said cable drums are mounted on bearing means supported on said shaft means and include respective opposed hub members engageable with said torsion spring means, respectively, said bearing means are each engaged with means connected to said bracket means, respectively, for retaining said bearing means and said cable drums secured to said bracket means, respectively; and drive means operably connected to said shaft means adjacent one of said bracket means for rotating said shaft means in one direction, at will, to adjust the torsional deflection of said torsion spring means to provide a counterbalance force exerted by said cables, said drive means including means operable to prevent rotation of said shaft means in an opposite direction in response to a torsional effort exerted on said shaft means by said torsion spring means.

29. The mechanism set forth in claim 28 wherein:

said means connected to said bracket means comprises a support bushing engageable with said bearing means and with said bracket means, respectively, for retaining said bearing means and said cable drum in a predetermined position with respect to said bracket means.

30. The mechanism set forth in claim 29 wherein:

said support bushing includes a hub portion and opposed resiliently deflectable fingers projecting from said hub portion and engageable with said bearing means and with said bracket means, respectively, for retaining said cable drum in a predetermined position with respect to said bracket means while permitting rotation of said cable drum with respect to said bracket means.

31. In a counterbalancing mechanism for a vertical opening door for counterbalancing at least part of the weight of said door when said door is moved between open and closed positions, spaced apart bracket means disposed generally above and adjacent to said door, elongated shaft means extending between and supported on said bracket means, torsion spring means operably connected to said shaft means and opposed cable drums disposed around said shaft means and connected to one end of said torsion spring means, respectively and having flexible cables wound thereon and connected at a free end to said door, and the improvement characterized by:

a hub connected to one end of said torsion spring means and supported on said shaft for axial sliding movement along said shaft but nonrotatable relative to said shaft, said hub comprising a hub member including groove means formed thereon for engagement with said torsion spring means, and said hub member including means forming a generally circular segment shaped bore for receiving said shaft, said bore having a planar surface cooperable with a corresponding planar surface on said shaft and for engaging said shaft to permit axial sliding movement of said hub relative to said shaft but preventing rotation of said hub relative to said shaft, and at least part of said hub is formed of a molded polymer and includes a reinforcing member for reinforcing said part of said hub at said bore.

32. A counterbalance mechanism for a vertical opening door for counterbalancing at least part of the weight of said door when said door is moved between open and closed positions, said mechanism comprising:

spaced apart brackets disposed generally above and adjacent to said door;

an elongated shaft extending between and supported on said brackets;

spaced apart torsion springs each having one end operably connected to said shaft for rotation therewith;

opposed cable drums spaced apart on said shaft between said brackets, said drums each being connected to another end of each of said torsion springs, respectively, said cable drums having flexible cables wound thereon and connected at a free end depending from said cable drums to said door, respectively; and drive means operably connected to one end of said shaft and mounted on one of said brackets for rotating said shaft in one direction, at will, to adjust the torsional deflection of said torsion springs to provide a counterbalance force exerted by said cables, said drive means including means operable to prevent rotation of said shaft in an opposite direction in response to a torsional effort exerted on said shaft by said torsion springs.

33. The mechanism set forth in claim 32 wherein:

said drive means includes one way drive gear means drivably connected to said shaft and to means for rotating said one way drive gear means to adjust the deflection of said torsion springs, respectively.

34. The mechanism set forth in claim 33 wherein:

said drive means includes a housing detachably mounted on one of said brackets and including a portion engageable with said one bracket to preclude rotation of said housing with respect to said one bracket.

* * * * *